US011355083B2

(12) United States Patent
Nagasawa

(10) Patent No.: US 11,355,083 B2
(45) Date of Patent: Jun. 7, 2022

(54) CORRECTION DEVICE, DISPLAY DEVICE, METHOD OF PERFORMING CORRECTION FOR DISPLAY DEVICE, AND METHOD OF MANUFACTURING DISPLAY DEVICE

(71) Applicant: SHENZHEN TOREY MICROELECTRONIC TECHNOLOGY CO. LTD., Shenzhen (CN)

(72) Inventor: Kazuhiro Nagasawa, Sakai (JP)

(73) Assignee: SHENZHEN TOREY MICROELECTRONIC TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 16/435,827

(22) Filed: Jun. 10, 2019

(65) Prior Publication Data

US 2019/0385571 A1 Dec. 19, 2019

Related U.S. Application Data

(60) Provisional application No. 62/684,600, filed on Jun. 13, 2018.

(51) Int. Cl.
*G09G 5/10* (2006.01)

(52) U.S. Cl.
CPC ..... *G09G 5/10* (2013.01); *G09G 2320/0233* (2013.01); *G09G 2360/145* (2013.01); *G09G 2360/16* (2013.01)

(58) Field of Classification Search
CPC ..... G09G 2320/0233; G09G 2360/145; G09G 2360/16; G09G 2320/0626
See application file for complete search history.

(56) References Cited

U.S. PATENT DOCUMENTS 8,693,801 B2 * 4/2014 Nakamura ..... G06T 5/002 382/264
10,770,034 B2 * 9/2020 Yonezawa ..... H04N 5/66
2006/0214940 A1 * 9/2006 Kinoshita ..... G09G 3/3208 345/589

(Continued)

FOREIGN PATENT DOCUMENTS

JP 2011-34004 A 2/2011

*Primary Examiner* — William Boddie
*Assistant Examiner* — Bipin Gyawali
(74) *Attorney, Agent, or Firm* — ScienBiziP, P.C.

(57) ABSTRACT

[Object] To reduce the amount of data used for performing correction for a display device.

[Solution] There is provided a correction device (2) including a correction-value calculation unit (6) that divides a display area of a display device into a plurality of unit areas and that calculates a correction value of luminance for each of the plurality of unit areas, a prioritized-area determination unit (8) that designates each of the plurality of unit areas as one of a prioritized area and a non-prioritized area in accordance with the calculated correction value, a recording unit (10) that records in a memory unit (M) a piece of data of the correction value for the prioritized area, and a correction unit (12) that corrects luminance for the prioritized area in accordance with the piece of data recorded in the memory unit and that uniformly corrects luminance for the non-prioritized area.

12 Claims, 8 Drawing Sheets

(56) References Cited

U.S. PATENT DOCUMENTS

| | | | | |
|---|---|---|---|---|
| 2011/0032264 | A1 | 2/2011 | Ietomi | |
| 2011/0032281 | A1 | 2/2011 | Ietomi | |
| 2012/0044224 | A1* | 2/2012 | Michisaka | G09G 3/3648 345/207 |
| 2016/0027369 | A1* | 1/2016 | Guo | G09G 3/2003 345/694 |
| 2016/0104411 | A1* | 4/2016 | Nathan | G09G 3/3241 345/690 |
| 2018/0040271 | A1* | 2/2018 | Jung | G06F 3/1446 |
| 2018/0342224 | A1* | 11/2018 | Beon | G09G 5/10 |
| 2019/0130811 | A1* | 5/2019 | Yonezawa | G09G 3/2092 |

* cited by examiner

16: CORRECTION DEVICE
18: IMAGING UNIT
D2: DISPLAY DEVICE
DA: DISPLAY AREA
NA: FRAME AREA
M: MEMORY UNIT

CORRECTION DEVICE, DISPLAY DEVICE, METHOD OF PERFORMING CORRECTION FOR DISPLAY DEVICE, AND METHOD OF MANUFACTURING DISPLAY DEVICE

TECHNICAL FIELD

The present invention relates to a technique to correct luminance of a display device.

BACKGROUND ART

As a correction technique for reducing luminance non-uniformity of a display device, PTL 1 discloses a technique in which tabulated data that records a correction value for each pixel is prepared.

CITATION LIST

Patent Literature

[PTL 1] Japanese Unexamined Patent Application Publication No. 2011-034004 (disclosed on Feb. 17, 2011)

SUMMARY OF INVENTION

Technical Problem

In PTL 1, as the resolution or the size of a display panel in a display device increases, the number of pixels increases, leading to an increase in the amount of data in a table that records correction values.

Solution to Problem (1) An aspect of the present invention provides a correction device that corrects luminance of a display device including a correction-value calculation unit that divides a display area of the display device into a plurality of unit areas and that calculates a correction value of luminance for each of the plurality of unit areas, a prioritized-area determination unit that designates each of the plurality of unit areas as one of a prioritized area and a non-prioritized area in accordance with the calculated correction value, a recording unit that records in a memory unit a piece of data of the correction value for the prioritized area, and a correction unit that corrects luminance for the prioritized area in accordance with the piece of data recorded in the memory unit and that uniformly corrects luminance for the non-prioritized area.

(2) Further, an aspect of the present invention provides the correction device that has the configuration described in (1) above and in which correction information including information regarding the prioritized area and information regarding the correction value is calculated in advance, the correction information is stored in the memory unit, and correction is performed in accordance with the correction information stored in the memory unit.

(3) Further, an aspect of the present invention provides the correction device that has the configuration described in (1) or (2) above and in which the prioritized-area determination unit calculates an evaluation value for each of the plurality of unit areas, the evaluation value being calculated for evaluating luminance variation in each of the plurality of unit areas, and selects the prioritized area from the plurality of unit areas in descending order of the evaluation value.

(4) Further, an aspect of the present invention provides the correction device that has any one of the configurations described in (1) to (3) above and in which the prioritized-area determination unit determines at least one group that has a substantially rectangular shape and that includes two or more of the prioritized areas that are adjacent to each other, and the recording unit associates a piece of data of the correction value relating to each of the at least one group with positional information of the each of the at least one group and positional information in the each of the at least one group and records the piece of data of the correction value in the memory unit.

(5) Further, an aspect of the present invention provides the correction device that has any one of the configurations described in (1) to (4) above and in which the prioritized-area determination unit selects the prioritized areas so that an amount of data of the correction values to be recorded in the memory unit is equal to or less than a predetermined amount of data.

(6) Further, an aspect of the present invention provides the correction device that has the configuration described in (5) above and in which the correction-value calculation unit determines the predetermined amount of data in accordance with the calculated correction values.

(7) Further, an aspect of the present invention provides the correction device that has any one of the configurations described in (1) to (6) above and in which the correction unit performs correction for the non-prioritized areas by uniformly decreasing luminance.

(8) An aspect of the present invention provides a display device including the correction device that has any one of the configurations described in (1) to (7) above.

(9) An aspect of the present invention provides a method of correcting luminance of a display device including dividing a display area of the display device into a plurality of unit areas and calculating a correction value of luminance for each of the plurality of unit areas, designating each of the plurality of unit areas as one of a prioritized area and a non-prioritized area in accordance with the calculated correction value, recording in a memory unit a piece of data of the correction value for the prioritized area, and correcting luminance for the prioritized area in accordance with the piece of data recorded in the memory unit and uniformly correcting luminance for the non-prioritized area.

(10) An aspect of the present invention provides a method of manufacturing a display device, the method including the method of correcting luminance of the display device having the configuration described in (9) above.

Advantageous Effects of Invention

According to an aspect of the present invention, the amount of data used for performing correction for a display device can be reduced.

DESCRIPTION OF EMBODIMENTS

First Embodiment

Figure 1:
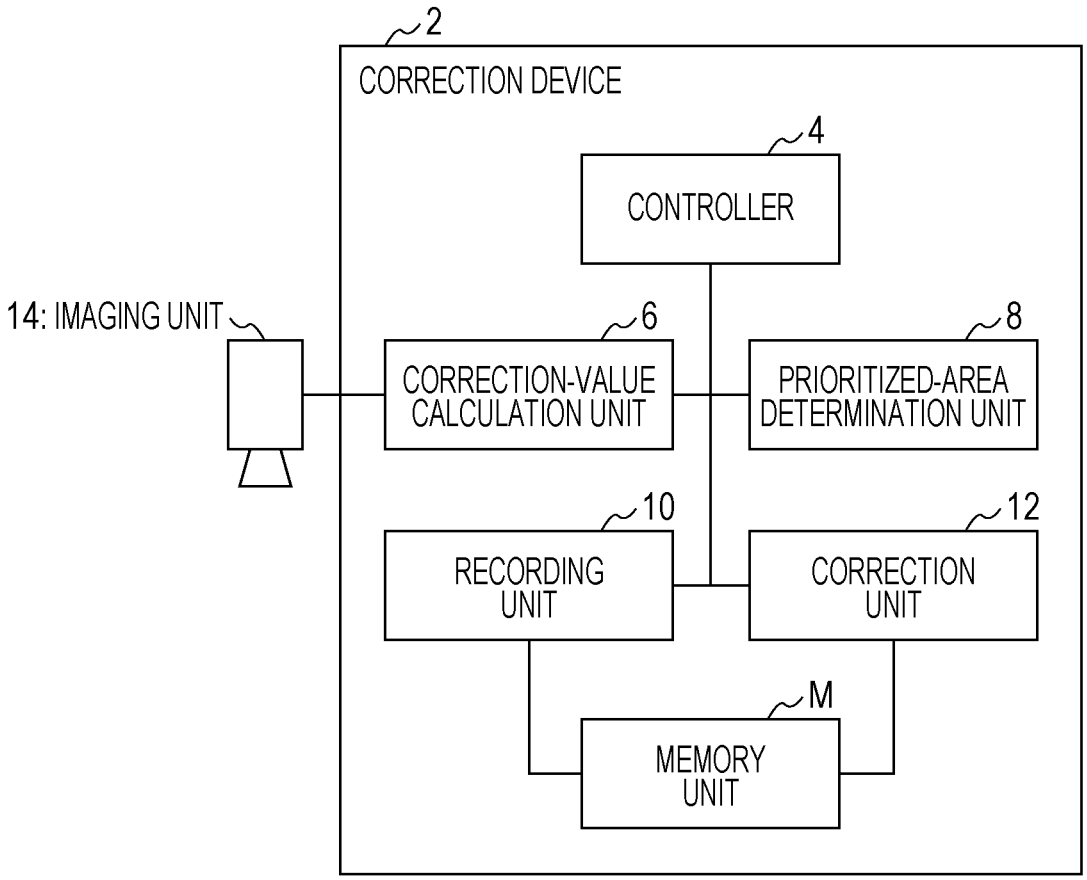
FIG. 1 is a block diagram of a correction device according to a first embodiment of the present invention.

FIG. 1 is a block diagram illustrating a correction device 2 according to the present embodiment. The correction device 2 is a device for correcting luminance of a display device. Specifically, the correction device 2 divides a display surface of the display device into a plurality of areas and corrects the luminance of each area of the display device so that the amounts of luminance variation among the plurality of areas are averaged.

The correction device 2 includes a controller 4, a correction-value calculation unit 6, a prioritized-area determination unit 8, a recording unit 10, and a correction unit 12. The controller 4 controls the correction-value calculation unit 6, the prioritized-area determination unit 8, the recording unit 10, and the correction unit 12.

The correction-value calculation unit 6 divides a display area of the display device into a plurality of areas and calculates a luminance correction value for each of the plurality of areas. In the present embodiment, the correction-value calculation unit 6 captures an image of the display device by using an imaging unit 14, which is placed outside the correction device 2, and measures the luminance of the display device. The correction-value calculation unit 6 calculates the luminance of and the correction value for each of the plurality of areas by using image data obtained by using the imaging unit 14.

The prioritized-area determination unit 8 designates each of the plurality of areas as one of a prioritized area and a non-prioritized area in accordance with the correction value calculated by the correction-value calculation unit 6. A prioritized area is to be prioritized in correcting the luminance, and a non-prioritized area is not to be prioritized in correcting the luminance.

The recording unit 10 records in a memory unit M a piece of data of the correction value for each area designated as a prioritized area by the prioritized-area determination unit 8. In the present embodiment, the correction device 2 includes the memory unit M, and the recording unit 10 associates positional information with the correction value for each prioritized area and records the positional information and the correction value in the memory unit M.

The correction unit 12 corrects the luminance of each of the plurality of areas of the display device in accordance with the correction value calculated for each of the plurality of areas of the display device. The correction unit 12 performs correction for each prioritized area in accordance with the positional information and the correction value recorded in the memory unit M for each prioritized area. On the other hand, for all the non-prioritized areas, the correction unit 12 uniformly corrects the luminance.

Figure 2:
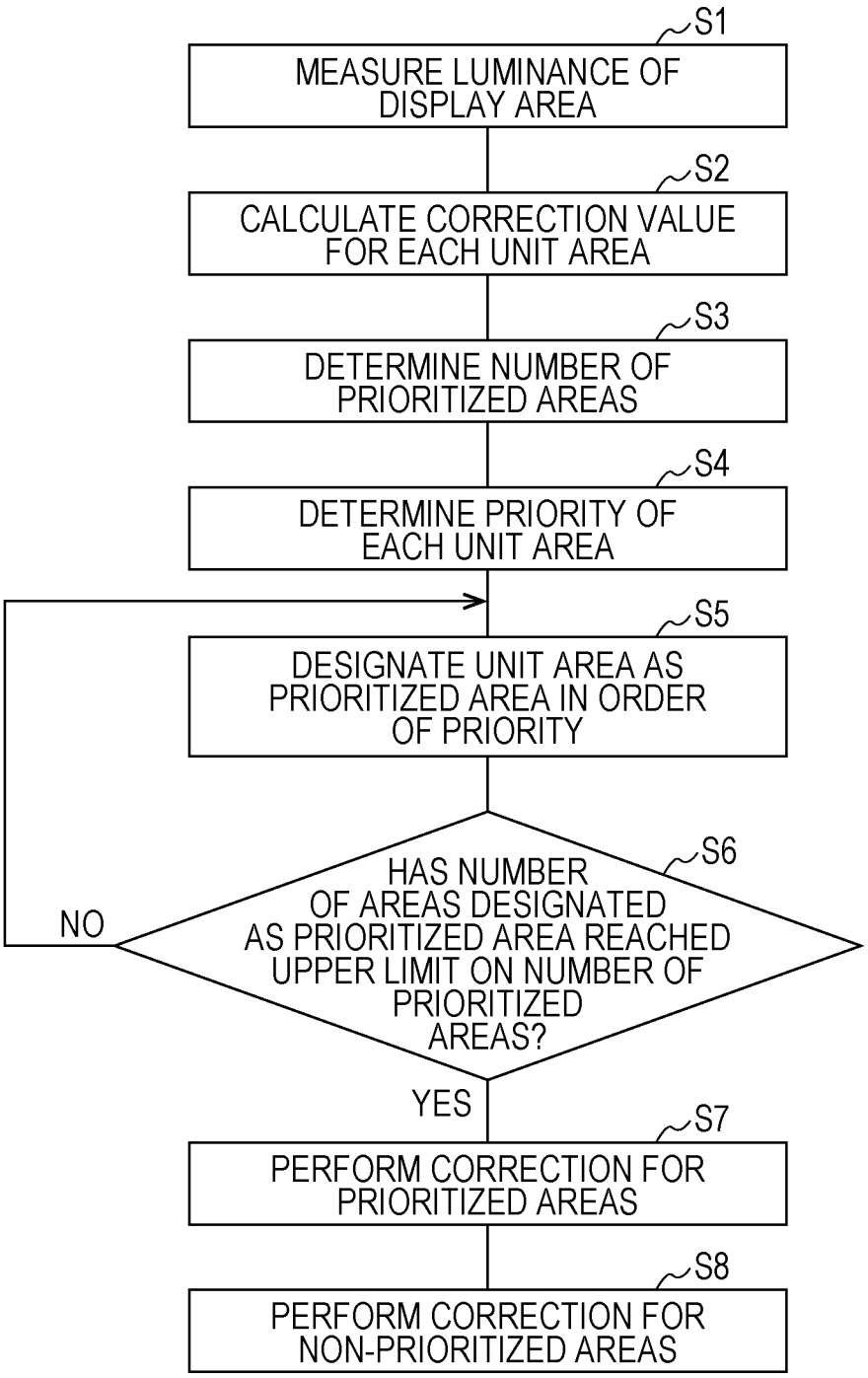
FIG. 2 is a flowchart for illustrating a method of performing correction for a display device according to the first embodiment of the present invention.
Figure 3:
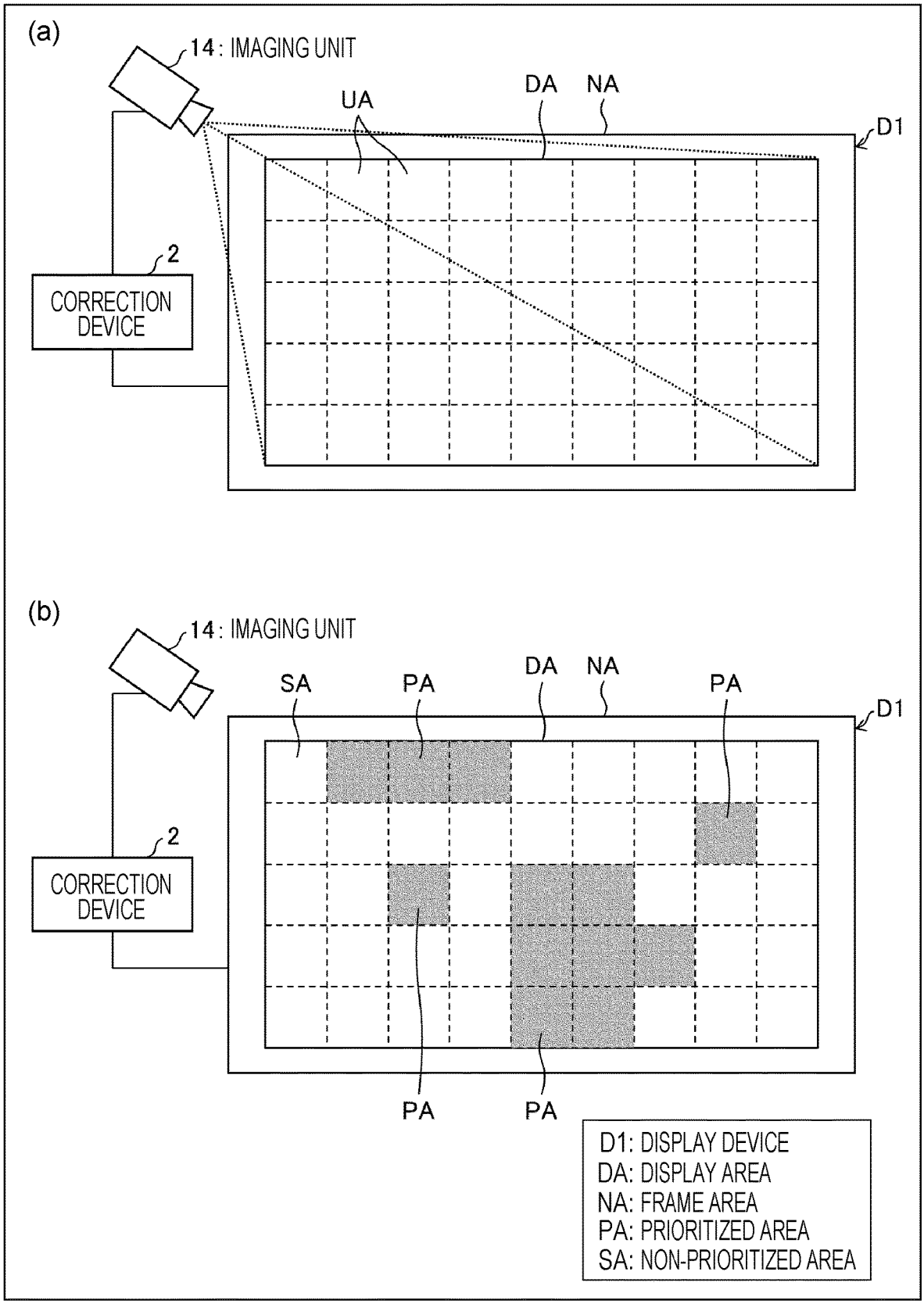
FIG. 3 presents schematic diagrams for illustrating an example of a method of performing correction for a display device, and the method uses the correction device according to the first embodiment of the present invention.

With reference to FIG. 2 and FIG. 3, an example of a specific method of performing correction for a display device D1 by using the correction device 2 according to the present embodiment will be described. FIG. 2 is a flowchart for illustrating a method of performing correction for the display device D1 by using the correction device 2 according to the present embodiment. FIG. 3 presents schematic diagrams illustrating the way of performing correction for the display device D1 by using the correction device 2 in accordance with the flowchart depicted in FIG. 2.

In the present embodiment, the display device D1 includes pixels and includes a display area DA, which contributes to display, and a frame area NA, which surrounds the display area DA and does not contribute to display. Further, the display area DA is divided into a plurality of unit areas UA. In the present embodiment, each unit area UA is a substantially rectangular area, and the plurality of unit areas UA are arranged in a matrix in the display area DA, as depicted in FIG. 3 (*a*). The size of a unit area UA or the number of unit areas UA may be determined as appropriate in consideration of factors such as the number of pixels contained in a unit area UA and the size of the display area DA.

First, an image of the display device D1 is captured by using the imaging unit 14, and the luminance of the display device is measured (step S1). In step S1, the imaging unit 14 captures an entire image of the display area DA of the display device D1, as depicted in FIG. 3 (*a*). For example, the imaging unit 14 may capture an image of a display surface of the display device D1 when the full screen is displayed in white or in gray in the gradation for which generated correction data is used.

Next, the correction-value calculation unit 6 calculates the correction value for a unit area UA of the display device D1 by using the image data of the display device D1 obtained by using the imaging unit 14 (step S2). Specifically, first, a unit area UA is divided into a plurality of smaller areas, such as pixel areas, which are minimum areas, and the luminance of each of the minimum areas is obtained from the image data.

In the present embodiment, of all the unit areas UA in the display area DA, the unit area UA that has the smallest average luminance value is designated as the base area. The magnitude of the correction value for a minimum area is defined as the difference from the average luminance value of the base area.

Next, the number of prioritized areas, which are prioritized in correcting the luminance, is determined in accordance with the result of the correction values calculated by the correction-value calculation unit 6 (step S3). The number of prioritized areas may be determined by the prioritized-area determination unit 8 or may be a predetermined number determined in advance by installed hardware. Further, the number of prioritized areas may be determined in accordance with the average value of all the calculated correction values. For example, if the average value of all the correction values calculated in step S2 is large, the number of prioritized areas may be set to a large number in step S3. Further, the number of prioritized areas may be determined in consideration of the capacity of the memory unit M, in which data of the correction values is to be recorded in a later operation.

Figure 4:
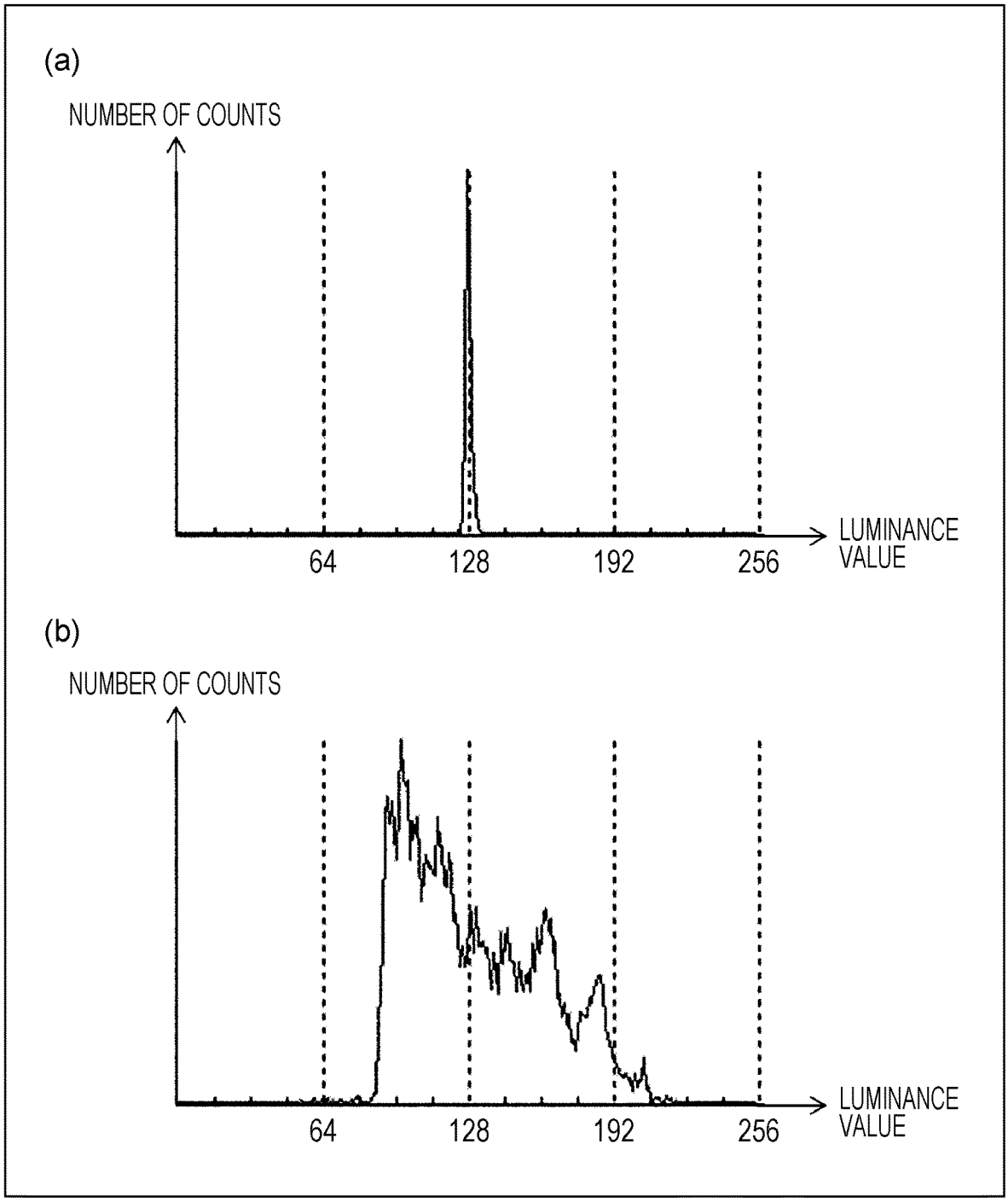
FIG. 4 presents graphs each of which illustrates luminance variation in a unit area of the display device according to the first embodiment of the present invention.

Then, the priority of a unit area UA in performing correction is determined by the prioritized-area determination unit 8 (step S4). A method of determining the priority will be described with reference to FIG. 4. FIG. 4 presents graphs each of which illustrates luminance variation in a unit area UA of the display device D1 when the target gradation is the 128th in the gradation scale.

Counting the number of minimum areas that have each luminance value by using the luminance data of each minimum area, which has been obtained in step S2, provides graphs as depicted in FIG. 4. In FIG. 4 (*a*) and FIG. 4 (*b*), the horizontal axis denotes the magnitude of a luminance value of a minimum area, and the vertical axis denotes the number of minimum areas counted for each luminance value denoted by the horizontal axis. FIG. 4 (*a*) and FIG. 4 (*b*) present the numbers of minimum areas that are included in two different unit areas UA and that are counted for each luminance value.

In the present embodiment, the priority of each unit area UA is determined by using the number of minimum areas counted for each luminance value depicted in FIG. 4. A specific example of a method of determining the priorities will be described with reference to Tables 1 and 2.

TABLE 1

| Luminance difference | Number of counts | Weight | Score |
|---|---|---|---|
| 0-31 | 95 | 1 | 95 |
| 32-63 | 3 | 2 | 6 |
| 64-95 | 1 | 3 | 3 |
| 96-127 | 0 | 4 | 0 |
| 128-159 | 0 | 5 | 0 |
| 160-191 | 1 | 6 | 6 |
| 192-223 | 0 | 7 | 0 |
| 224-255 | 0 | 8 | 0 |
| | | Evaluation value | 110 |

TABLE 2

| Luminance difference | Number of counts | Weight | Score |
|---|---|---|---|
| 0-31 | 20 | 1 | 20 |
| 32-63 | 25 | 2 | 50 |
| 64-95 | 37 | 3 | 111 |
| 96-127 | 9 | 4 | 36 |
| 128-159 | 6 | 5 | 30 |
| 160-191 | 0 | 6 | 0 |
| 192-223 | 0 | 7 | 0 |
| 224-255 | 0 | 8 | 0 |
| | | Evaluation value | 247 |

Tables 1 and 2 illustrate an example of a method to obtain an evaluation value for determining the priority of each unit area UA presented in FIG. 4 (*a*) and FIG. 4 (*b*), respectively. In Tables 1 and 2, the column denoted by "Luminance difference" contains absolute values of luminance differences, each of which is a difference between the average luminance value of the base area, which has the smallest average luminance value of all the unit areas UA, and the luminance value of a minimum area in a unit area UA. The column denoted by "Number of counts" contains the numbers of minimum areas, each of the numbers indicating the number of minimum areas having the luminance difference in the interval of luminance difference indicated in a corresponding row in the column "Luminance difference". The column denoted by "Score" contains the products of the numbers in the column "Number of counts" and the corresponding numbers in the column "Weight". The row denoted by "Evaluation value" contains the sum of all the numbers in the column "Score".

As the luminance difference increases, the number in the column "weight" increases. Accordingly, as the number of minimum areas that have a large luminance difference from the average luminance value of the base area described above increases, the scores and the evaluation value of a unit area UA increase. Thus, it can be said that the magnitude of an evaluation value represents in a simplified manner the magnitude of luminance variation in the unit area UA with respect to the average luminance value of the base area described above.

If the magnitude of the evaluation value in Table 1 and the magnitude of the evaluation value in Table 2 are compared, the evaluation value in Table 2 is larger. Thus, the priority of the unit area UA presented in FIG. 4 (*b*) is higher than the priority of the unit area UA presented in FIG. 4 (*a*). In step S4, evaluation values of all the unit areas UA are calculated in a similar manner by the prioritized-area determination unit 8, and the priorities are determined. In the present embodiment, a method of calculating an evaluation value in a simplified manner is described. The calculation method is not limited to this example, and the sum of absolute values of luminance differences of all the minimum areas may be treated as an evaluation value.

Next, unit areas UA are designated as a prioritized area one by one in order of priority, which has been determined in step S4 (step S5). Specifically, a unit area UA may be designated as a prioritized area by attaching a tag to the coordinate data indicating the position of the unit area UA, the tag indicating that the unit area UA is a prioritized area. At this time, whenever a unit area is designated as a prioritized area, it is determined whether the number of prioritized areas has reached the upper limit on the number of prioritized areas, which has been determined in step S3 (step S6). If the number of prioritized areas has not reached the upper limit on the number of prioritized areas, another unit area is designated as a prioritized area. In this way, steps S5 and S6 are repeated until the number of prioritized areas reaches the upper limit on the number of prioritized areas.

FIG. 3 (*b*) is a diagram for illustrating an example of prioritized areas of the display device D1 observed when step S6 is completed. In FIG. 3 (*b*), each hatched unit area UA of the plurality of unit areas UA is an area designated as a prioritized area PA. Unit areas UA that have not been designated as a prioritized area PA are non-prioritized areas SA, which are presented in FIG. 3 (*b*) as unit areas UA that are not hatched.

When the number of prioritized areas reaches the upper limit on the number of prioritized areas in step S6, correction is performed for the prioritized areas (step S7). When correction is performed for a prioritized area, first, coordinates of the prioritized area, coordinates of a minimum area in the prioritized area, and a correction value for the minimum area are associated with each other and recorded in the memory unit M by the recording unit 10. Next, the correction unit 12 performs correction in accordance with the data recorded in the memory unit M.

When correction is performed for a prioritized area, it is unnecessary to record correction values for all the minimum areas in the memory unit M. For example, a few representative correction values for a unit area UA may be recorded in the memory unit M, and correction may be performed for a minimum area that does not have a representative correction value by using an interpolated value derived from the representative correction values.

After the correction for prioritized areas is completed, correction is performed for non-prioritized areas (step S8).

In the present embodiment, uniform luminance correction is applied to all the non-prioritized areas.

Figure 5:
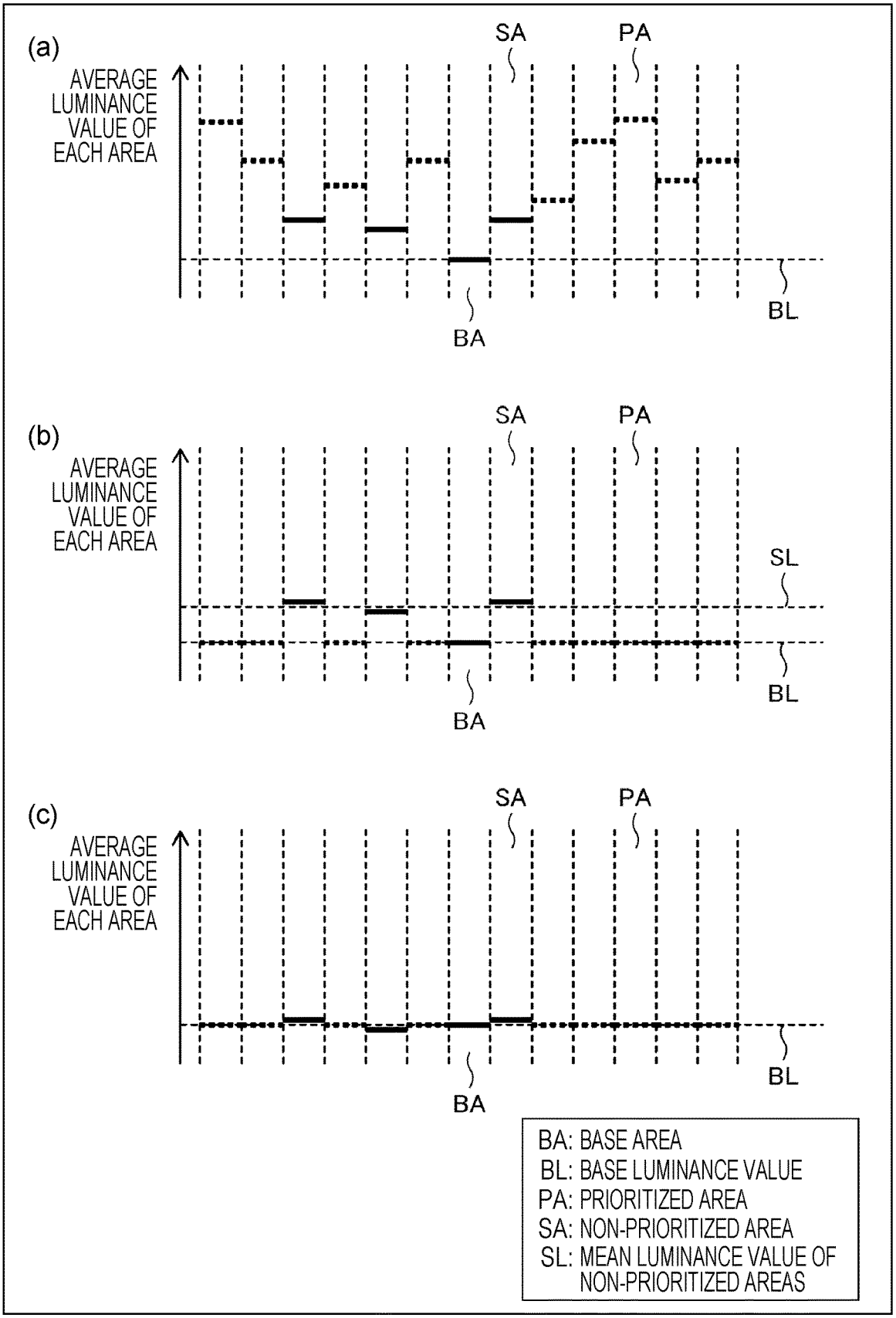
FIG. 5 presents diagrams depicting luminance of unit areas of the display device, and the diagrams illustrate a specific method of performing correction for prioritized areas and for non-prioritized areas in the method of performing correction for the display device according to the first embodiment of the present invention.

A specific example of performing correction for prioritized areas and non-prioritized areas will be described with reference to FIG. 5. In FIG. 5 (*a*) to FIG. 5 (*c*), the horizontal axis denotes unit areas UA, and the vertical axis denotes the average luminance value of each of the unit areas UA. FIG. 5 (*a*) presents the average luminance value of each unit area UA of the display device D1 observed before correction when steps up to step S6 are completed. FIG. 5 (*b*) presents the average luminance value of each unit area UA observed when correction has been performed only for the prioritized areas PA of the display device D1 depicted in FIG. 5 (*a*). FIG. 5 (*c*) presents the average luminance value of each unit area UA observed when, in addition, correction has also been performed for the non-prioritized areas SA of the display device D1 depicted in FIG. 5 (*b*). In FIG. 5 (*a*) to FIG. 5 (*c*), each of the dotted lines denotes the average luminance value of each of the prioritized areas PA.

As depicted in FIG. 5 (*a*), the unit area UA that has the smallest average luminance value of all the unit areas UA is designated as the base area BA. Then, the average luminance value of the base area BA is referred to as the base luminance value BL. In the example depicted in FIG. 5 (*a*), unit areas whose priorities rank first to ninth have been designated as a prioritized area PA.

When correction is performed for the prioritized areas PA, the average luminance values of the prioritized areas PA become substantially equal to the base luminance value BL, as depicted in FIG. 5 (*b*), because correction is performed for the prioritized areas PA in accordance with the correction data recorded in the memory unit M. Then, when correction is to be performed for the non-prioritized areas SA, the mean luminance value of the non-prioritized areas SL, which is obtained by further averaging the average luminance values of the non-prioritized areas SA, is calculated first. In the present embodiment, correction is performed for the non-prioritized areas SA by decreasing the luminance of all the non-prioritized areas SA by the amount equal to the luminance difference between the mean luminance value of the non-prioritized areas SL and the base luminance value BL. Thus, when correction is performed for the non-prioritized areas SA, the average luminance value of each of the non-prioritized areas SA is as depicted in FIG. 5 (*c*).

In the method of performing correction by using the correction device 2 according to the present embodiment, only some of the unit areas UA of the display device D1 are designated as a prioritized area, and the remaining unit areas UA are designated as a non-prioritized area. In addition, the correction device 2 records in the memory unit M only correction data for prioritized areas and does not record correction data for non-prioritized areas, uniformly correcting the luminance. Accordingly, the amount of correction data to be recorded in the memory unit M can be reduced.

Further, in the present embodiment, unit areas UA are designated as a prioritized area in descending order of correction value, which is calculated for each unit area UA. Because of this, unit areas UA that are designated as a prioritized area have large luminance differences from the luminance value designated as the reference level. Thus, it is favorable to perform precise luminance correction for prioritized areas.

On the other hand, in the present embodiment, correction values for non-prioritized areas are not very large. Thus, the luminance differences from the luminance value designated as the reference level are small for non-prioritized areas, and precise correction may be avoided. Therefore, even if uniform luminance correction is performed for non-prioritized areas, an effect on luminance variation of the display area DA can be reduced. Accordingly, efficient luminance correction for the display device D1 is possible by performing precise correction for prioritized areas and performing uniform luminance correction for non-prioritized areas.

In the present embodiment, the prioritized-area determination unit 8 can determine the number of prioritized areas in consideration of the capacity of the memory unit M. Specifically, the prioritized-area determination unit 8 can determine the number of prioritized areas so that the amount of data of the correction values to be recorded in the memory unit M is equal to or less than a predetermined amount of data. In this way, if the capacity of the memory unit M is limited, efficient correction can be performed for the display device D1.

The prioritized-area determination unit 8 may determine the predetermined amount of data in accordance with correction values for unit areas UA calculated by the correction-value calculation unit 6. For example, if correction values for unit areas UA are large, that is, luminance variation of the display device D1 is large, the prioritized-area determination unit 8 may set the predetermined amount of data to a large value, so that more unit areas UA are designated as a prioritized area. In this way, it is possible to perform more suitable luminance correction in accordance with luminance variation of the display device D1.

In the present embodiment, of the average luminance values of all the unit areas UA, the smallest average luminance value is designated as the base luminance value BL, which is the reference level for correction. Accordingly, correction for prioritized areas and correction for non-prioritized areas are both correction that decreases luminance.

The present embodiment presents an example in which correction for each unit area UA is performed by decreasing luminance and thus efficient luminance correction for the display device D1 can be performed. However, in the present embodiment, correction is not limited to this example. Of the average luminance values of all the unit areas UA, the largest average luminance value may be designated as the base luminance value BL, which is the reference level for correction, and correction for unit areas UA may be correction that increases luminance.

In the present embodiment, the base luminance value BL is defined to be the smallest average luminance value of the average luminance values of all the unit areas UA. However, this is not construed to be limiting, and the base luminance value BL, which is the reference level for correction, may be defined to be the smallest luminance value of the luminance values of all the unit areas UA, that is, the smallest luminance value of the luminance values of all the minimum areas.

Further, in the present embodiment, the luminance values of the non-prioritized areas SA are uniformly decreased by the luminance difference between the base luminance value BL and the mean luminance value of the non-prioritized areas SL. However, in the present embodiment, the magnitude of luminance correction for the non-prioritized areas SA is not limited to the luminance difference mentioned above. For example, the smallest luminance value of the luminance values of all the non-prioritized areas SA or the smallest luminance value of the average luminance values of the non-prioritized areas SA may be adopted instead of the mean luminance value of the non-prioritized areas SL. Alternatively, the largest luminance value of the luminance values of all the non-prioritized areas SA or the largest luminance value of the average luminance values of the non-prioritized areas SA may be adopted instead of the mean luminance value of the non-prioritized areas SL.

In the present embodiment, the correction device 2 is located outside the display device D1. For example, the correction device 2 may be included in a manufacturing device for the display device D1 and may correct luminance non-uniformity of the display device D1 that is generated during a manufacturing stage. In regard to this, the display device D1 may be manufactured by using a manufacturing method including the correction method described above. In addition, the correction device 2 may be installed outside the display device D1 as an external correction device and may perform correction for the display device D1.

Second Embodiment

A correction device 2 according to the present embodiment may have the same configuration as the correction device 2 according to the preceding embodiment. In the present embodiment, a method of performing correction for the display device D1 is different from the correction method according to the preceding embodiment only in that an operation of grouping prioritized areas is further included. Specifically, the method of performing correction for the display device D1 in the present embodiment may similarly be performed from step S1 to step S6 described above.

In the present embodiment, the method of performing correction for the display device D1 is different only in that a grouping operation is included between step S6 and step S7 described above, the grouping operation determining at least one group that has a substantially rectangular shape and that includes a plurality of prioritized areas PA that are adjacent to each other. The grouping operation will be described in detail with reference to FIGS. 6 and 7.

Figure 6:
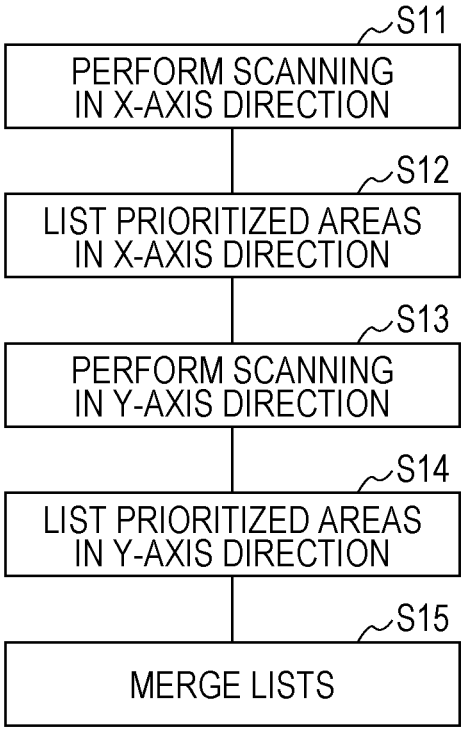
FIG. 6 is a flowchart for illustrating a method of grouping in a method of performing correction for a display device according to a second embodiment of the present invention.
Figure 7:
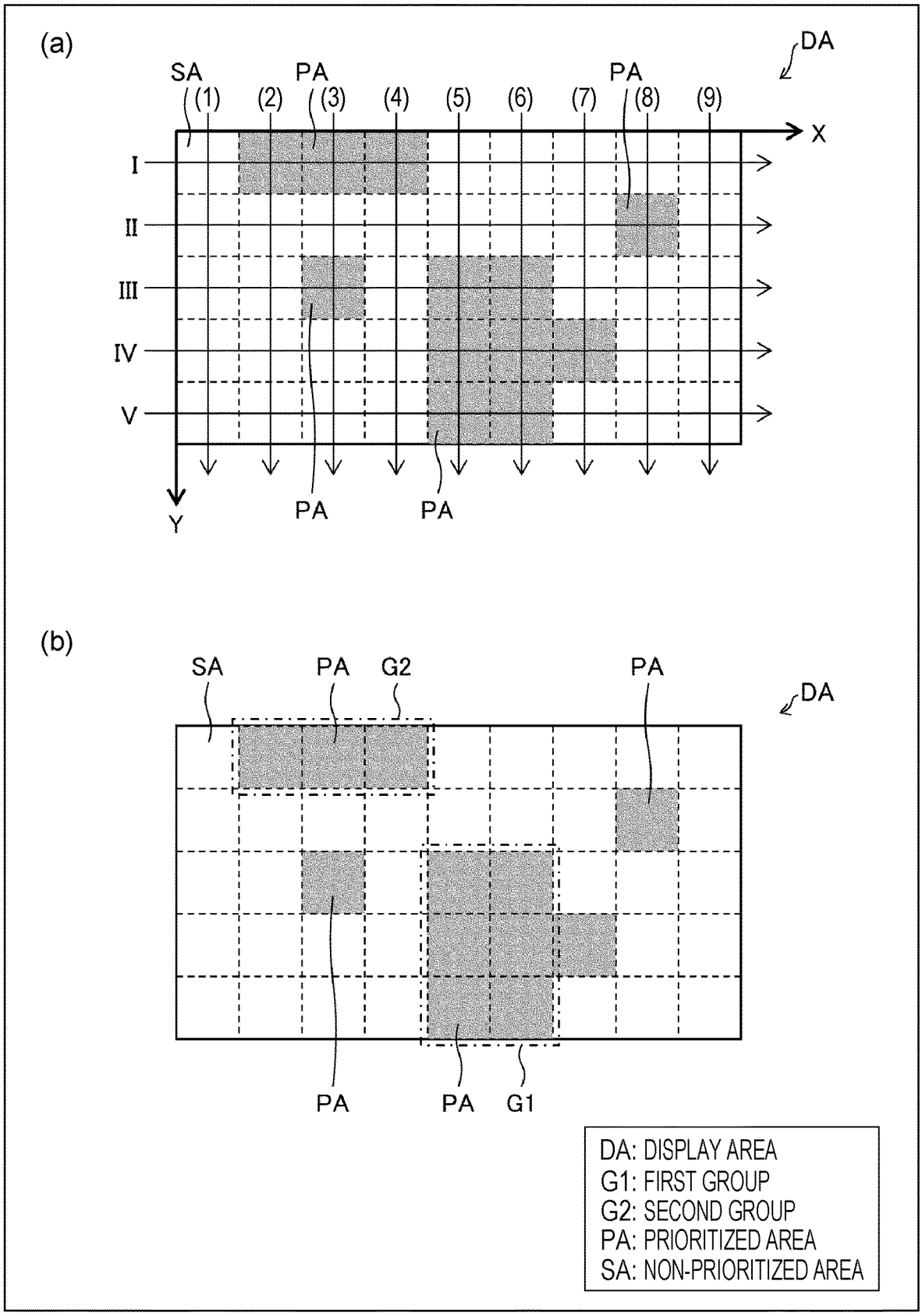
FIG. 7 presents schematic diagrams for illustrating an example of grouping prioritized areas, and the grouping is performed by using a correction device according to the second embodiment of the present invention.

FIG. 6 is a flowchart for illustrating a method of grouping in the method of performing correction for the display device D1 according to the present embodiment. FIG. 7 presents enlarged schematic diagrams of the display area DA illustrating the way of grouping prioritized areas PA of the display device D1 by using the correction device 2 in accordance with the flowchart depicted in FIG. 6. In the present embodiment, each unit area UA is specified by using coordinates. In the present embodiment, the X-axis is directed from the left to the right, and the Y-axis is directed from the top to the bottom in the drawings in FIG. 7. For example, the coordinates of a unit area UA located at the top left position of the display area DA are denoted by (1, 1) and the coordinates of a unit area UA located at the bottom right position are denoted by (9, 5).

In the grouping operation in the present embodiment, first, scanning is performed in the X-axis direction, and a position of a unit area UA designated as a prioritized area PA in the coordinate is detected (step S11). Then, the coordinates of a unit area UA designated as a prioritized area PA are listed (step S12). In FIG. 7 (*a*), for example, scanning in the X-axis direction is performed in order from Roman numeral 1 to Roman numeral 5, and coordinates of prioritized areas PA are listed in order. At this time, if a neighboring prioritized area PA in the X-axis direction is present for a prioritized area PA, the coordinates of these multiple prioritized areas PA are added to a single list.

Lists of coordinates of prioritized areas PA in the X-axis direction when step S11 and step S12 are completed are presented in Table 3.

TABLE 3

| List number | Coordinates | | |
|---|---|---|---|
| 1 | (2, 1) | (3, 1) | (4, 1) |
| 2 | (8, 2) | | |
| 3 | (3, 3) | | |
| 4 | (5, 3) | (6, 3) | |
| 5 | (5, 4) | (6, 4) | (7, 4) |
| 6 | (5, 5) | (6, 5) | |

Here, the column denoted by "List number" contains numbers each of which is assigned to a corresponding one of the plurality of lists, and the column denoted by "Coordinates" contains coordinates of one or more prioritized areas PA included in each of the plurality of lists. In the present embodiment, six lists from list 1 to list 6 are produced. Here, the coordinates (2, 1), (3, 1), and (4, 1) are arranged consecutively in the X-axis direction and thus included in a single list, which is list 1. However, for example, although the coordinates (3, 3) have the same Y-axis coordinate as the coordinates (5, 3) and (6, 3), the coordinates (3, 3) are adjacent to neither the coordinates (5, 3) nor the coordinates (6, 3) and thus are not included in the list in which the coordinates (5, 3) and the coordinates (6, 3) are included.

Next, similarly to step S11, scanning is also performed in the Y-axis direction, and a position of a unit area UA designated as a prioritized area PA in the coordinate is detected (step S13). Then, the coordinates of a unit area UA designated as a prioritized area PA are listed (step S14). In FIG. 7 (*a*), for example, scanning in the Y-axis direction is performed in order from numeral 1 to numeral 9 in parentheses, and coordinates of prioritized areas PA are listed in order. At this time, if a neighboring prioritized area PA in the Y-axis direction is present for a prioritized area PA, the coordinates of these multiple prioritized areas PA are added to a single list.

Lists of coordinates of prioritized areas PA in the Y-axis direction when step S13 and step S14 are completed are presented in Table 4.

TABLE 4

| List number | Coordinates | | |
|---|---|---|---|
| 1 | (2, 1) | | |
| 2 | (3, 1) | | |
| 3 | (3, 3) | | |
| 4 | (4, 1) | | |
| 5 | (5, 3) | (5, 4) | (5, 5) |
| 6 | (6, 3) | (6, 4) | (6, 5) |
| 7 | (7, 4) | | |
| 8 | (8, 2) | | |

Here, the column denoted by "List number" contains numbers each of which is assigned to a corresponding one of the plurality of lists, and the column denoted by "Coordinates" contains coordinates of one or more prioritized areas PA included in each of the plurality of lists. In the present embodiment, eight lists from list 1 to list 8 are produced. Here, the coordinates (5, 3), (5, 4), and (5, 5) are arranged consecutively in the Y-axis direction and thus included in a single list, which is list 5. However, for example, although the coordinates (3, 3) have the same X-axis coordinate as the coordinates (3, 1), the coordinates (3, 3) are not adjacent to the coordinates (3, 1) and thus are not included in the list in which the coordinates (3, 1) are included.

Finally, the coordinate lists of prioritized areas PA depicted in Table 3 and Table 4 are merged, and prioritized areas PA are assigned to a group so that the group forms a substantially rectangular shape (step S15). In step S15, a group of prioritized areas PA are specified so that the number of prioritized areas PA included in the group of a substantially rectangular shape is as large as possible.

In the present embodiment, for example, as depicted in FIG. 7 (*b*), the coordinates from (5, 3) to (6, 5) are assigned to the first group G1, and the coordinates from (2, 1) to (4, 1) are assigned to the second group G2. The coordinates (7, 4) are not included in the first group G1 because a substantially rectangular shape is not formed if the coordinates (7, 4) are included. The prioritized-area determination unit 8 may perform the assignment to a group.

In a group to which coordinates are assigned, a piece of data of a correction value relating to the group is associated with the positional information of the group and the positional information in the group and recorded in the memory unit M. For example, the position at the top left of a group may be recorded as the start address, and thereby the positional information of the group may be recorded. Further, distances from the start address of the group in the X-axis direction and in the Y-axis direction may be recorded, and thereby the positional information in the group may be recorded. The data in which the positional information relating to a group described above and a piece of data of a correction value are associated with each other may be recorded in the memory unit M by the recording unit 10.

After step S15 is completed, the process proceeds to step S7 described above, and correction is performed for prioritized areas PA. At this time, in the present embodiment, correction is performed in accordance with pieces of data in each of which the position of a group, a position in the group, and the correction value at the position in the group are associated with each other, the pieces of data having been recorded in the memory unit M. Correction that is the same as or similar to the correction performed in the preceding embodiment may be performed for prioritized areas PA that are not included in a group and for non-prioritized areas SA.

The correction device 2 according to the present embodiment records in the memory unit M only the start address of a group and a position with respect to the start address as the data to be associated with a correction value relating to the group. Accordingly, the amount of data to be recorded in the memory unit M can be reduced. In particular, the correction device 2 according to the present embodiment is especially favorable for the display device D1 when areas that have large non-uniformity appear in a continuous form.

Third Embodiment

Figure 8:
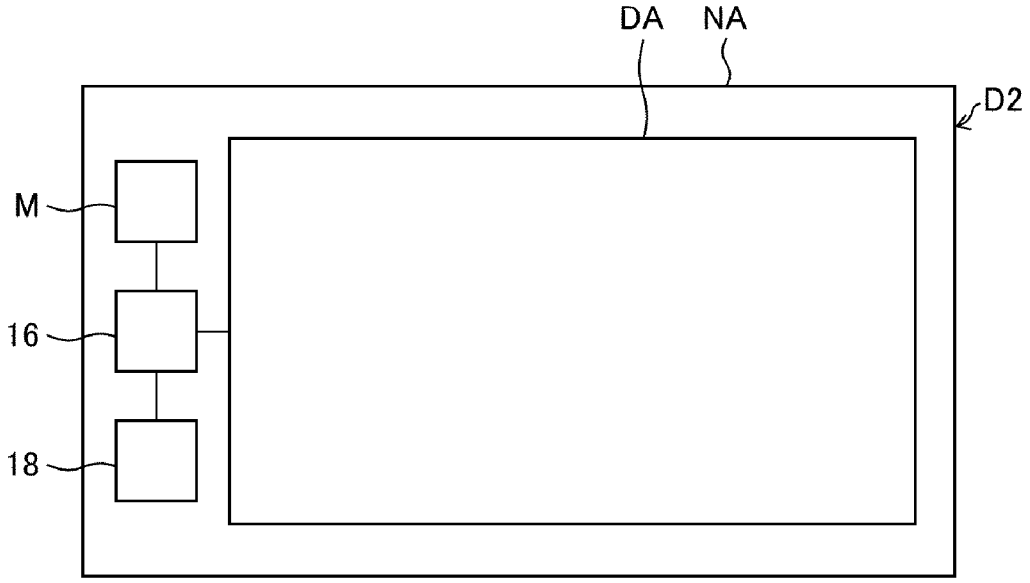
FIG. 8 is a block diagram of a correction device and a display device according to a third embodiment of the present invention.

FIG. 8 is a block diagram illustrating a display device D2 according to the present embodiment. The display device D2 according to the present embodiment is configured differently from the display device D1 only in that a correction device 16, an imaging unit 18, and a memory unit M are further included in a frame area NA. The correction device 16 may have the same configuration as the correction device 2 in the previous embodiments except that the memory unit M is not included.

The imaging unit 18 measures luminance at each position of a display area DA of the display device D2. The imaging unit 18 can transmit obtained luminance data to a correction-value calculation unit 6 in the correction device 16.

Luminance correction for the display device D2 according to the present embodiment is performed in accordance with the steps depicted in FIG. 2. In addition, the steps depicted in FIG. 6 may be performed between step S6 and step S7.

The amount of data recorded in the memory unit M can be reduced because the display device D2 according to the present embodiment includes the correction device 16. Further, the display device D2 according to the present embodiment can correct luminance non-uniformity in the display area DA as appropriate by using the correction device 16. Correction for the display device D2 by using the correction device 16 may automatically be performed, for example, when the power is turned on or turned off.

In addition, the display device D2 includes the memory unit M inside. Accordingly, the memory unit M can record not only correction data but also data to be used for other circuits in the display device D2. In this case, of the capacity of the memory unit M, the capacity for recording correction data can be reduced, and more capacity for recording data to be used for other circuits can be secured.

In the present embodiment, if a portion of the capacity of the memory unit M is used, for example, as a first in, first out (FIFO) memory, the resistance to underflow and overflow can be enhanced. Further, in the present embodiment, if a portion of the capacity of the memory unit M is used, for example, for a line buffer or a frame buffer, more data can be buffered.

In the present embodiment, the display device D2 includes the correction device 16 and the imaging unit 18 inside. However, this is not construed to be limiting, and the correction device 16 and the imaging unit 18 may be installed outside the display device D2 as external devices. In this case, the correction device 16 may transmit and receive data to and from the memory unit M included inside the display device D2.

[Example Realized by Using Software]

The correction-value calculation unit 6 and the prioritized-area determination unit 8 of the correction device in each of the embodiments described above may be realized by using logical circuits (hardware) formed on an integrated circuit (IC) chip or the like or may be realized by using software.

In the latter case, the correction device includes a computer that executes instructions in a correction program, which is software that realizes the calculation of correction values and the determination of prioritized areas. Such a computer includes, for example, at least one processor (control device) along with at least one recording medium that is computer readable and that stores the correction program. In the computer, the processor reads the correction program from the recording medium and executes the correction program, and thereby a purpose of the present invention is achieved.

For example, a central processing unit (CPU) can be used as the processor. As the recording medium, a "non-transitory physical medium", such as, besides a read-only memory (ROM), a tape, a disc, a card, a semiconductor memory, and a programmable logic circuit can be used. A random access memory (RAM) and the like onto which the correction program is loaded may further be included.

The correction program may be provided to the computer via any transmission medium (such as a communication network and a broadcasting wave) that can transmit the correction program. An aspect of the present invention can be realized in the form of a data signal embedded in a carrier wave, the data signal representing the correction program by using electronic transmission.

When the correction-value calculation unit 6 and the prioritized-area determination unit 8 are realized by using software, the correction device calculates in advance, by using the software, correction information including information regarding prioritized areas and information regarding correction values and stores the correction information in the memory unit M. Then, the correction device performs correction for the display device in accordance with the correction information that has been stored in the memory unit M by using the software.

Realizing the correction-value calculation unit 6 and the prioritized-area determination unit 8 by using software makes it possible to deal with the settings regarding the calculation of correction values and the determination of prioritized areas only by configuring software settings. Thus, if luminance non-uniformity that is difficult to anticipate in the initial stage of designing various portions of the correction device is generated in the display area DA, the possibility of dealing with the luminance non-uniformity only by changing the software settings without changing the design of various portions of the correction device is increased.

The present invention is not limited to the embodiments described above, and various modifications are possible within the scope defined in the claims. An embodiment obtained by appropriately combining technical methods disclosed in each of the embodiments is also within the technical scope of the present invention. Further, combining technical methods disclosed in each of the embodiments can produce a new technical feature.

REFERENCE SIGNS LIST

2, 16 correction device
6 correction-value calculation unit
8 prioritized-area determination unit
10 recording unit
12 correction unit
M memory unit
D1, D2 display device
PA prioritized area
SA non-prioritized area
UA unit area

The invention claimed is:

1. A correction device that corrects luminance of a display device, comprising:

a correction-value calculation unit that divides a display area of the display device into a plurality of unit areas and that calculates a plurality of correction values of luminance, one for each of the plurality of unit areas;

a prioritized-area determination unit that designates each of the plurality of unit areas as one of a plurality of prioritized areas and a plurality of non-prioritized areas in accordance with the plurality of correction values;

a recording unit that records in a memory unit a piece of data of the plurality of correction values for the plurality of prioritized areas; and a correction unit that corrects luminance for the plurality of prioritized areas in accordance with the piece of data recorded in the memory unit and also corrects luminance of the plurality of non-prioritized areas including areas with different luminance by decreasing the luminance of all of the plurality of non-prioritized areas by equal amounts, wherein the recording unit does not record correction data for the plurality of non-prioritized areas in the memory unit.

2. The correction device according to claim 1, wherein correction information including information regarding the plurality of prioritized areas and information regarding the plurality of correction values is calculated in advance of correction performed by the correction unit, the correction information is stored in the memory unit, and the correction is performed in accordance with the correction information stored in the memory unit.

3. The correction device according to claim 1, wherein the prioritized-area determination unit calculates an evaluation value for each of the plurality of unit areas, the evaluation value being calculated for evaluating luminance variation in each of the plurality of unit areas, and selects the plurality of prioritized areas from the plurality of unit areas in descending order of the evaluation value.

4. The correction device according to claim 1, wherein:

the prioritized-area determination unit determines at least one group that has a substantially rectangular shape and that includes two or more of the plurality of prioritized areas that are adjacent to each other, and the recording unit associates a piece of data of the correction value relating to each of the at least one group with positional information of the each of the at least one group and positional information within the each of the at least one group, and records the piece of data of the correction value in the memory unit.

5. The correction device according to claim 1, wherein the prioritized-area determination unit determines an upper limit on a number of the plurality of prioritized areas so that a total amount of data of the plurality of correction values to be recorded in the memory unit is equal to or less than a predetermined amount of data.

6. The correction device according to claim 5, wherein the correction-value calculation unit determines the predetermined amount of data in accordance with the plurality of correction values.

7. The correction device according to claim 5, wherein the prioritized-area determination unit designates one of the plurality of unit areas as the plurality of prioritized areas one-by-one, and finishes designation of the plurality of prioritized areas when the total amount of data of the plurality of correction values to be recorded in the memory unit exceeds the predetermined amount of data.

8. The correction device according to claim 1, wherein the equal amounts correspond to a difference between a mean luminance value of a unit area having smallest average luminance value of all of the plurality of unit areas and a mean luminance value of the non-prioritized areas.

9. A display device comprising:

the correction device according to claim 1.

10. The correction device according to claim 1, wherein:

the equal amounts correspond to a luminance difference between a first luminance based on a base area among the plurality of unit areas and a second luminance based on at least one of the non prioritized areas.

11. A method of correcting luminance of a display device, comprising:

dividing a display area of the display device into a plurality of unit areas and calculating a plurality of correction values of luminance, one for each of the plurality of unit areas;

designating each of the plurality of unit areas as one of a plurality of prioritized areas and a plurality of non-prioritized areas in accordance with the plurality of correction values;

recording in a memory unit a piece of data of the plurality of correction values for the plurality of prioritized areas; and correcting luminance for the plurality of prioritized areas in accordance with the piece of data recorded in the memory unit and also correcting luminance of a plurality of non-prioritized areas including areas with different luminance by decreasing the luminance of all of the plurality of non-prioritized areas by equal amounts, wherein correction data for the plurality of non-prioritized area is not recorded in the memory unit.

12. A method of manufacturing a display device, the method including the method of correcting luminance of the display device according to claim 11.

* * * * *